US006760704B1

(12) United States Patent
Bennett

(10) Patent No.: US 6,760,704 B1
(45) Date of Patent: Jul. 6, 2004

(54) SYSTEM FOR GENERATING SPEECH AND NON-SPEECH AUDIO MESSAGES

(75) Inventor: Steven M. Bennett, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 619 days.

(21) Appl. No.: 09/676,104

(22) Filed: Sep. 29, 2000

(51) Int. Cl.[7] ..... G10L 13/00
(52) U.S. Cl. ..... 704/270; 379/88.22; 455/412
(58) Field of Search ..... 455/412, 413; 704/270, 275; 379/88.08, 88.12, 88.16, 88.18, 88.22

(56) References Cited

U.S. PATENT DOCUMENTS 4,646,346 A * 2/1987 Emerson et al. ..... 379/214.01
5,384,832 A * 1/1995 Zimmerman et al. ..... 379/67
5,647,002 A * 7/1997 Brunson ..... 709/206
5,717,923 A 2/1998 Dedrick
6,023,700 A * 2/2000 Owens et al. ..... 707/10
6,032,039 A * 2/2000 Kaplan ..... 455/413
6,233,318 B1 * 5/2001 Picard et al. ..... 379/88.13
6,317,485 B1 * 11/2001 Homan et al. ..... 379/88.12
6,549,767 B1 * 4/2003 Kawashima ..... 455/412.2

* cited by examiner

*Primary Examiner*—Daniel Abebe
(74) *Attorney, Agent, or Firm*—Blakely, Sokoloff, Taylor & Zafman LLP

(57) ABSTRACT

An audio information system that may be used to form and convey an audio message having speech overlapped with non-speech audio is provided. The system has components to store a context indicator having non-speech audio to signify a characteristic of a speech content stream, to merge the context indicator with the speech content stream to form an integrated message, and to output the integrated message. The message has overlapping non-speech audio from the context indicator and speech audio. The system also has mechanisms to vary the format of integrated message generated in order to train the user on non-speech cues. In addition, other aspects of the present invention relating to the audio information system receiving content and generating an audio message are described.

27 Claims, 10 Drawing Sheets

SYSTEM FOR GENERATING SPEECH AND NON-SPEECH AUDIO MESSAGES

NOTICE OF COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

1. Field of the Invention

The present invention relates generally to systems for processing information and conveying audio messages and more particularly to systems using speech and non-speech audio streams to produce audio messages.

2. Background

Technology is rapidly progressing to permit convenient access to an abundance of personalized information at any time and from any place. "Personalized information" is information that is targeted for or relevant to an individual or defined group rather than generally to the public at large. There are a plethora of sources for personalized information, such as the World Wide Web, telephones, personal organizers (PDA's), pagers, desktop computers, laptop computers and numerous wireless devices. Audio information systems may be used to convey this information to a user, i.e. listener of the message, as a personalized information message.

At times a user may specifically request and retrieve the personalized information. Additionally, the system may proactively contact the user to deliver certain information, for example by sending the user an email message, a page, an SMS message on the cell phone, etc.

Previous information systems that provided such personalized information require that a user view the information and physically manipulate controls to interact with the system. Recently an increasing number of information systems are no longer limited to visual displays, e.g. computer screens, and physical input devices, e.g. keyboards. Current advances in the systems use audio to communicate information to and from a user of the system.

The audio enhanced systems are desirable because the user's hands may be free to perform other activities and the user's sight is undisturbed. Usually, the users of these information devices obtain personal information while "on-the-go" and/or while simultaneously performing other tasks. Given the current busy and mobile environment of many users, it is important for these devices to convey information in a quick and concise manner.

Heterogeneous information systems, e.g. unified messaging systems, deliver various types of content to a user. For example, this content may be a message from another person, e.g. e-mail message, telephone message, etc.; a calendar item; a news flash; a PIM functionality entry, e.g. to-do item, a contact name, etc.; a stock, traffic or weather report; or any other communicated information. Because of the variety of information types being delivered, it is often desirable for these systems to inform the user of the context of the information in order for the user to clearly comprehend what is being communicated. There are many characteristics of the content that are useful for the user to understand, such as information type, the urgency and/or relevance of the information, the originator of the information, and the like. In audio-only interfaces, this preparation is especially important. The user may become confused without knowledge as to the kind of content that is being delivered.

Visual user interfaces indicate information type through icons or through screen location. We call this context indication and the icon/screen location the context identifier. However, if only audio is used to convey information other context indicators must be used. The audio cues may be in the form of speech, e.g. voice, or non-speech sounds. Some examples of non-speech audio are bells, tones, nature sounds, music, etc.

Some prior audio information systems denote the context of the information by playing a non-speech sound before conveying the content. The auditory cues provided by the sequential playing systems permit a user to listen to the content immediately or decide to wait for a later time. These systems are problematic in that they are inconvenient for the user and waste time. The user must first focus on the context cue and then listen for the information.

Moreover, many of these systems further extend the time in which the user must attend to the system by including a delay, e.g. 3 to 20 seconds latency, between the delivering the notification and transmitting the content. In fact, some systems require the user to interact with the system after playing the preface in order to activate the playing of content. Thus, these interactive cueing systems distract the user from performing other tasks in parallel.

In general, people have the ability to discern more than one audio streams at a time and extract meaning from the various streams. For example, the "cocktail party effect," is the capacity of a person to simultaneously participate in more than one distinct stream of audio. Thus, a person is able to focus on one channel of speech and overhear and extract meaning from another channel of speech. See "The Cocktail Party Effect in Auditory Interfaces: A Study of Simultaneous Presentation" Lisa J. Stifelman, MIT Media Laboratory Technical Report, September 1994. However, this capability has not yet been leveraged in prior information systems using speech and non-speech.

In general, the shortcomings of the currently available audio information systems include lengthy and inefficient conveying of cue signals and information. In particular, previous audio information systems do not minimize interaction times.

BRIEF DESCRIPTION OF THE DRAWINGS

The present invention is illustrated by way of example, and not limitation, in the figures of the accompanying drawings in which:

FIGS. 1A–1E illustrates examples of various messages, wherein FIGS. 1A to 1C show variations of a prior art audio stream having a context indicator preceding a content speech information, FIG. 1D shows one embodiment with overlapping context indicator and content speech and FIG. 1E shows another embodiment having a speech and non-speech context indicator overlapped with content speech information.

FIGS. 3A–3D are block diagrams various embodiments of an audio information system, wherein FIG. 3A shows content information stored and converted to speech, FIG. 3B shows content information converted directly to speech, FIG. 3C shows content information stored and FIG. 3D shows an audio system where the content information is not stored or converted to speech.

DETAILED DESCRIPTION

The information system described below generates an integrated audio message having at least two synchronous streams of audio information that are simultaneously presented. At least one of the streams is speech information. The speech information streams, or any portion thereof, are overlapped with each other and with the non-speech information in the final message so that a user hears all of the streams at the same time. The non-speech portion of the message is contained within a context indicator that signifies at least one characteristic of the content information. The characteristic represented by the context indicator may be any description or property of the content such as content type, content source, relevance of the content, etc. The context indicator puts the speech content information into context to facilitate listening to the message. Thus, a user may focus on the speech portion(s) while overhearing the non-speech audio in a manner similar to hearing background music or sound effects that set the tone for a movie clip.

The speech content that is ultimately included in the outputted message is human language expressed in analog form. The types of speech content information conveyed by the system may be information originating from any kind of source or of any particular nature that may be transformed to a stream of audio, such as an e-mail message, telephone message, facsimile, a calendar item, a news flash, a PIM functionality entry, (e.g. to-do item or a contact name), a stock-quote, sports information, a traffic detail, a weather report, and other communicated speech, or combinations thereof. Often, the content information is personalized information. In one embodiment, the content information contains synthetic speech that is formed by the audio information system or other electronic device. In other embodiments, the speech is natural from a human voice.

A stream of speech information may be a single word or string of words. The audio information system integrates the speech-based content with a context indicator to form an integrated audio message that is more condensed than messages generated by previous audio systems.

Figure 1A:
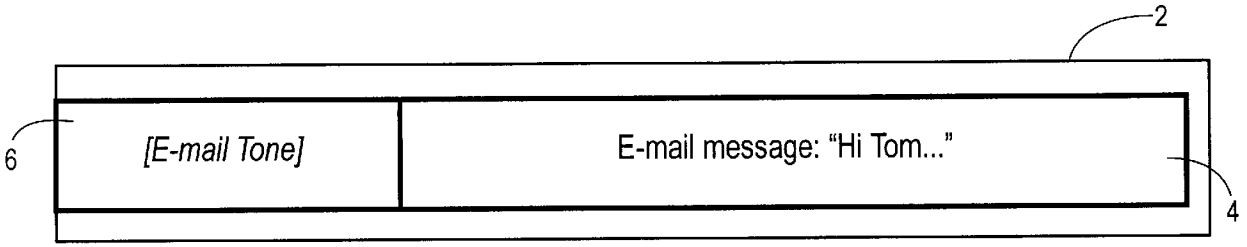
FIG. 1A (PRIOR ART)
Figure 1B:
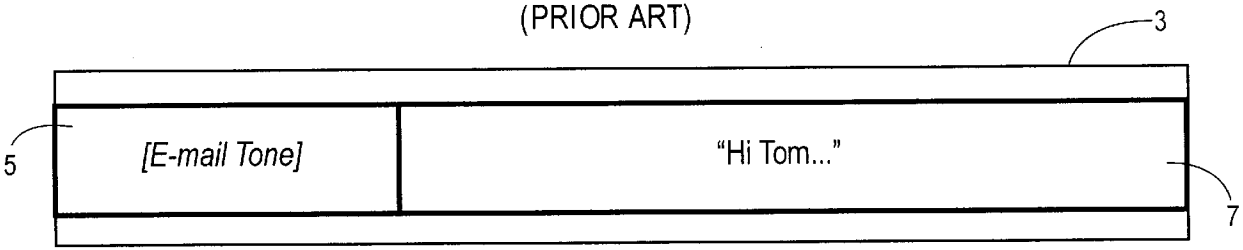
FIG. 1B (PRIOR ART)
Figure 1C:
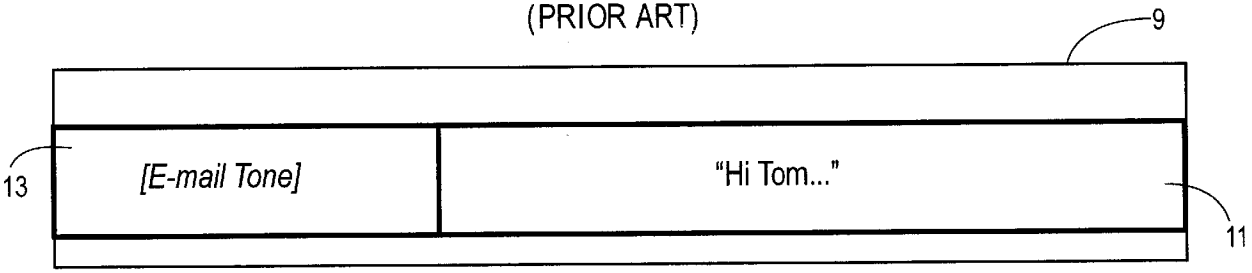
FIG. 1C (PRIOR ART)

Some prior art audio messages that are typical of previous audio systems are shown in FIGS. 1A–C with context and content information arranged in serial fashion, . This context information may convey the type of content, who had sent the content, its urgency or relevance to the user, and the like. For example, in FIG. 1A, audio message 2has a content portion 4, "E-mail message, Hi Tom . . . " The message also has non-speech context information 6, [e-mail tone], attached to the message prior to the content portion. The resulting message with sequentially occurring context and content information is lengthy and takes time for the user to hear.

Alternatively, previous systems may employ the message 3 shown in FIG. 1B. The content is preceded by non-speech context information 5. In still other prior systems, as shown in FIG. 1C, the message 9 has speech context information 13 followed by content 11. Although the messages depicted in FIGS. 1B and 1C are shorter than the message in FIG. 1A, they are still lengthy and take time for the user to hear.

Figure 1D:
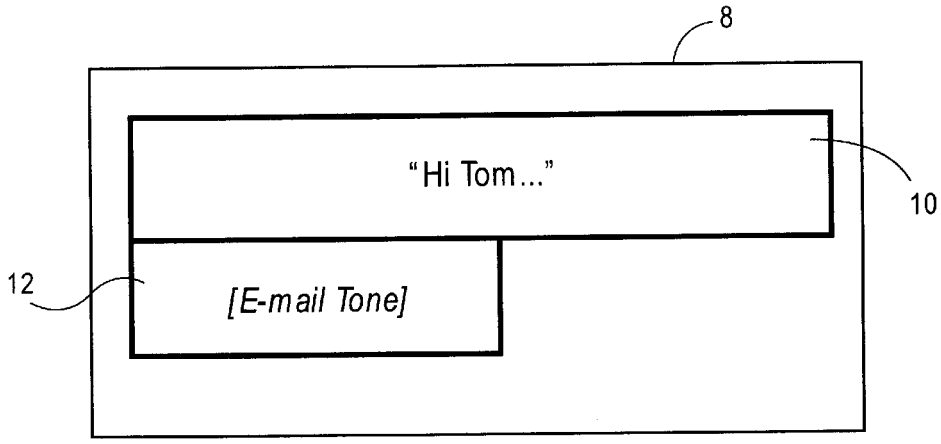

On the other hand, the audio information system of the present invention permits compact messages to be conveyed to a user. FIG. 1D shows one embodiment of an integrated audio message 8 formed by the present system having a context indicator 12 [e-mail tone], overlapped with the beginning portion of a content speech stream 10, "Hi Tom . . . ". The context indicator has non-speech audio to signify a characteristic of a speech content stream. In this example, the characteristic is the type of content, which is an e-mail message. Any sort of non-speech audio may be used, such as bells, tones, nature sounds, music, sirens, alarms, etc.

Figure 1E:
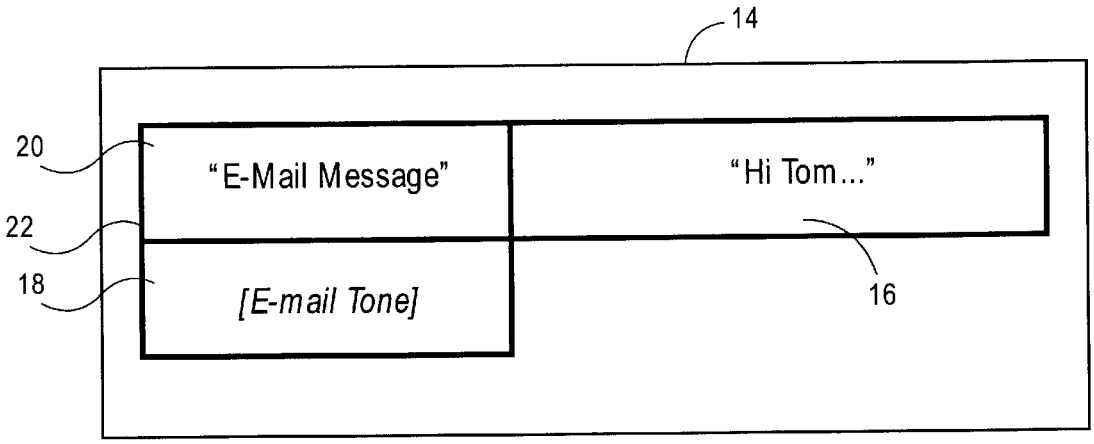

In an alternative embodiment, FIG. 1E shows an integrated message 14 generated by the audio information system that is used to facilitate recognition of the context indicator sound in conjunction with the characteristic of the content represented by the indicator. The message has a training context indicator 22, with a non-speech portion 18, [E-mail Tone], overlapped with a descriptive speech portion 20,"E-mail Message." This overlapped context indicator 22 is attached to content speech stream 16, "Hi Tom . . . ".

The training context indicator, i.e. signifying a particular characteristic, may be employed when the system determines that a user is not trained in the use of that particular context indicator. When the user learns to distinguish the sound of the context indicator, the audio information system may delete the descriptive speech portion 20 and overlap the context indicator with at least a portion of the speech content stream, resulting in the integrated message as shown in FIG. 1E. The methods that the system may use to determine if a user is trained or requires training are discussed below.

In other configurations of integrated message, the context indicator may signify two or more content characteristics. A non-speech portion of the context indicator may mean one characteristic of the content and this non-speech portion may be overlapped with a speech portion of the context indicator to describe another characteristic of the content information. For example, the context indicator may include a beeping sound to indicate an e-mail message synchronized with the words "Jim Smith" to inform the user of the source of the e-mail message. There may also be additional channels of sound mixed in, for example, a third context sound to indicate the urgency of the message. It would be clear to those skilled in the art, that various other configurations of messages are possible, where the non-speech portion of the context indicator overlaps with speech.

This invention also anticipates occasions where the integrated message may have multiple speech streams overlapped. Although, methods for combining a single speech audio stream with a single non-speech audio stream are exemplified below, more than one speech and/or non-speech streams are also intended to be within the scope of the present invention.

Figure 2:
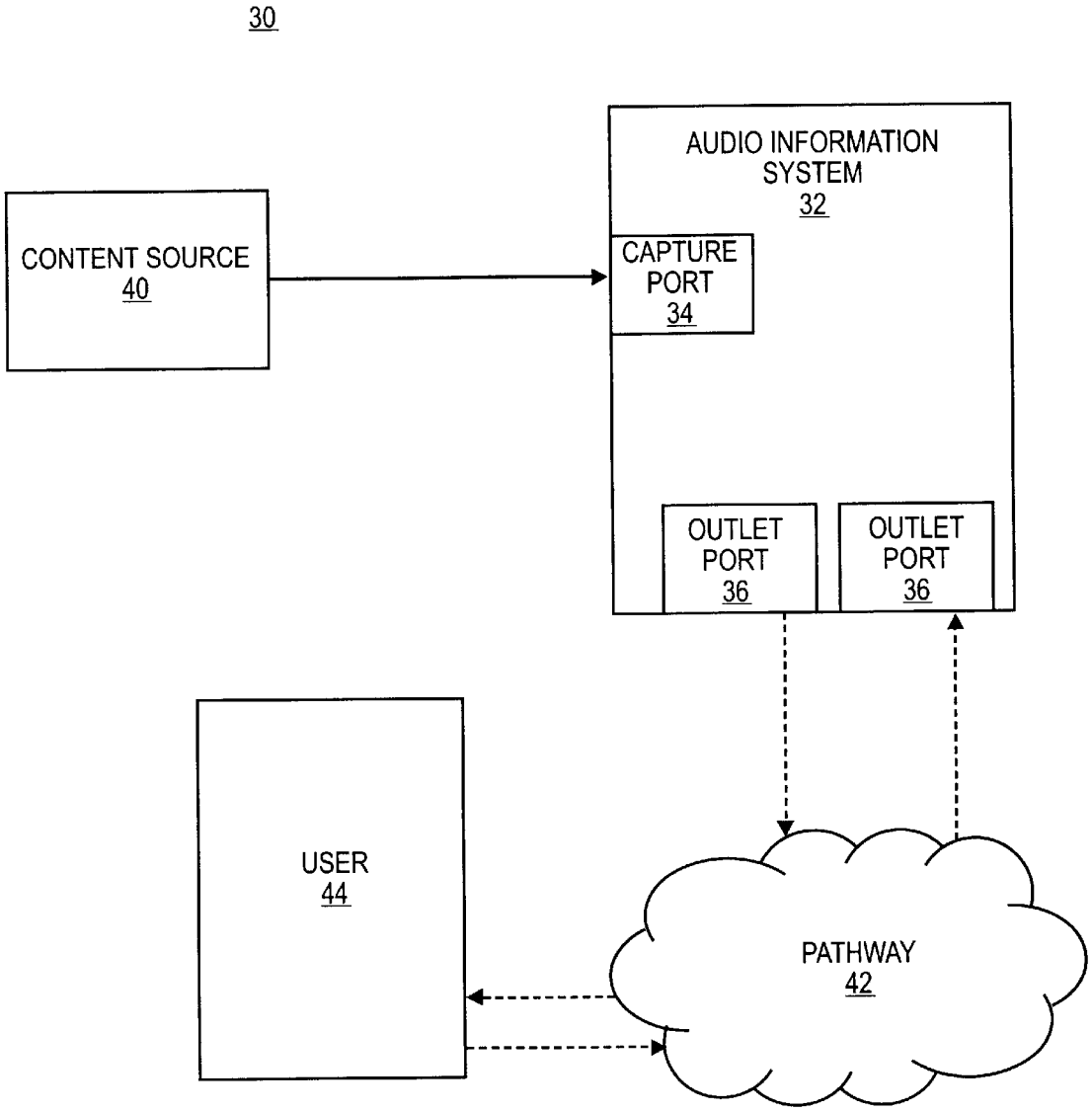
FIG. 2 illustrates one embodiment of an audio communication environment in which an audio information stream may be processed, in accordance with the teachings presented herein.

FIG. 2 illustrates an exemplary audio communication environment 30 in which speech information may be processed with non-speech information to produce an integrated message. An audio information system 32, according to one embodiment of the present invention, is in communication with a content source 40 at a capture port 34 (i.e. information collection interface). Audio information system 32 may read, combine, manipulate, process, store, delete, and/or output speech information provided by source 40. The output from an outlet port 36 on the audio information system is received by a user 44 through pathway 42. Input from the user is received by the system thorough an input port 37. Although FIG. 2 demonstrates one layout of audio communication environment 30, the scope of the present invention anticipates any number of information sources and users arranged in reference to the audio information system in various fashions and configured in accordance herewith.

The content source 40 is any supplier of information, e.g. personalized information, that is speech or may be converted into synthetic speech by the audio information system. In one embodiment, a human is the source of natural speech. In another case, the source may be a device that generates and transfers data or data signals, such as a computer, a server, a computer program, the Internet, a sensor, any one of numerous available voice translation devices, etc. For example, the source may be a device for transmitting news stories over a network.

Communication between the content source 40 and the audio information system 32 may be through a variety of communication schemes. Such schemes include an Ethernet connection (i.e., capture port 34 may be an Ethernet port), serial interfaces, parallel interfaces, RS422 and/or RS432 interfaces, Livewire interfaces, Appletalk busses, small computer system interfaces (SCSI), ATM busses and/or networks, token ring and/or other local area networks, universal serial buses (USB), PCI buses and wireless (e.g., infrared) connections, Internet connections, satellite transmission, and other communication links for transferring the information from the content source 40 to the audio information system 32. In addition, source 40 may store the information on a removable storage source, which is coupled to, e.g. inserted into, the audio information system 32 and in communication with the capture port 34. For example, the source 40 may be a tape, CD, hard drive, disc or other removable storage medium.

Audio information system 32 is any device configured to receive or produce the speech and non-speech information and to manipulate the information to create the integrated message, e.g. a computer system or workstation. In one embodiment, the information system 32 includes a platform, e.g. a personal computer (PC), such as a Macintosh® (from Apple Corporation of Cupertino, Calif.), Windows®-based PC (from Microsoft Corporation of Redmond, Wash.), or one of a wide variety of hardware platforms that runs the UNIX operating system or other operating systems. The system may also be other intelligent devices, such as telephones, e.g. cellular telephones, personal organizers (PDA's), pagers, and other wireless devices. The devices listed are by way of example and are not intended to limit the choice of apparatuses that are or may become available in the voice-enabled device field that may process and convey audio information, as described herein.

The audio information system 32 is configured to send the resulting integrated audio message to a user 44. User 44 may receive the integrated message from the audio information system 32 indirectly through a pathway 42 from the outlet port 36 of the system. The communication pathway 42 may be through various networking mechanisms, such as a FireWire (i.e. iLink or IEEE 1394 connection), LAN, WAN, telephone line, serial line Internet protocol (SLIP), point-to-point protocol (PPP), an XDSL link, a satellite or other wireless link, a cable modem, ATM network connection, an ISDN line, a DSL line, Ethernet, or other communication link. In the alternative, the pathway 42 may be a transmission medium such as air, water, and the like. The audio system may be controlled by the user through the input port 37. Similar to the output port 36, communication to this port may be direct or indirect through a wide variety of networking mechanisms.

The audio information system has components for handling speech and non-speech information in various ways. As shown variously in the examples in FIGS. 3A–D, these components may include the following:

(1) a capture port 34 for acquiring speech and/or non-speech information, (2) a storage unit 54 for holding information, (3) a combination unit 60 for generating an integrated message or sending instructions to do the same, (4) an optional input port 68 for receiving information from the user, (5) an optional control unit 72 which processes user requests and responses, and (6) an outlet port 36 for conveying the audio message to the user.

Often the components of the audio information system are coupled through one or multiple buses. Upon review of this specification, it will be appreciated by those skilled in the art that the components of audio information system 32 may be connected in various ways in addition to those described herein.

Now referring in more detail to the components shown in FIGS. 3A–D, audio information system 32 includes a capture port 34 in which content information 52, in the form of speech or data, is received. The capture port 34 may also be used to obtain the information for the context indicator 50. However, in alternative circumstances, the context information may be synthesized within the system by the appropriate software application rather than being imported through the capture port. Furthermore, multiple capture ports may be employed, e.g. one for content and the other for context.

The capture port 34 may receive data from the content source through a variety of means, such as I/O devices, the World Wide Web, text entry, pen-to-text data entry device, touch screen, network signals, satellite transmissions, pre-programmed triggers within the system, instructional input from other applications, etc. Some conventional I/O devices are keyboards, mouses/trackballs or other pointing devices, microphones, speakers, magnetic disk drives, optical disk drives, printers, scanners, etc.

Figure 3A:
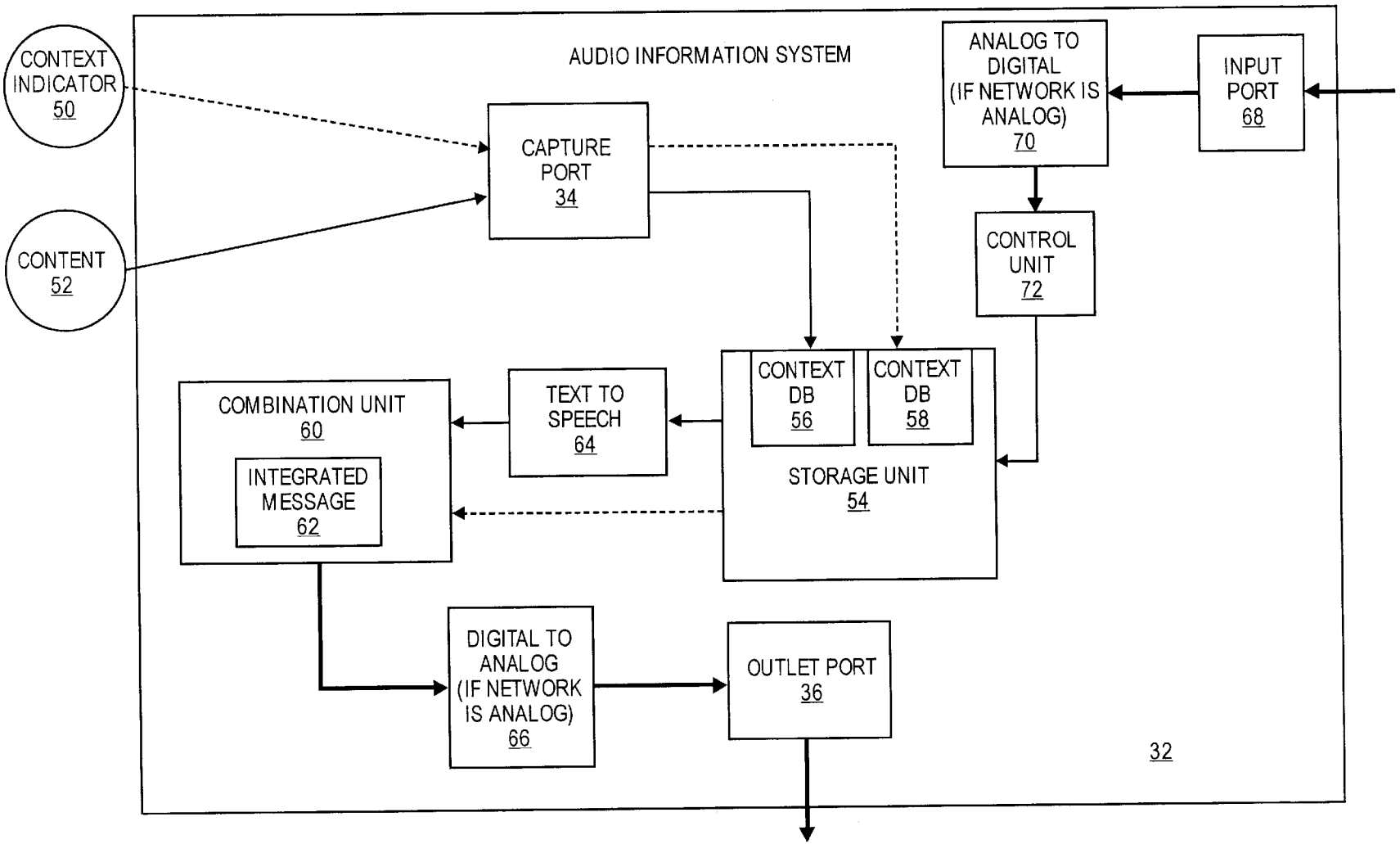
Figure 3B:
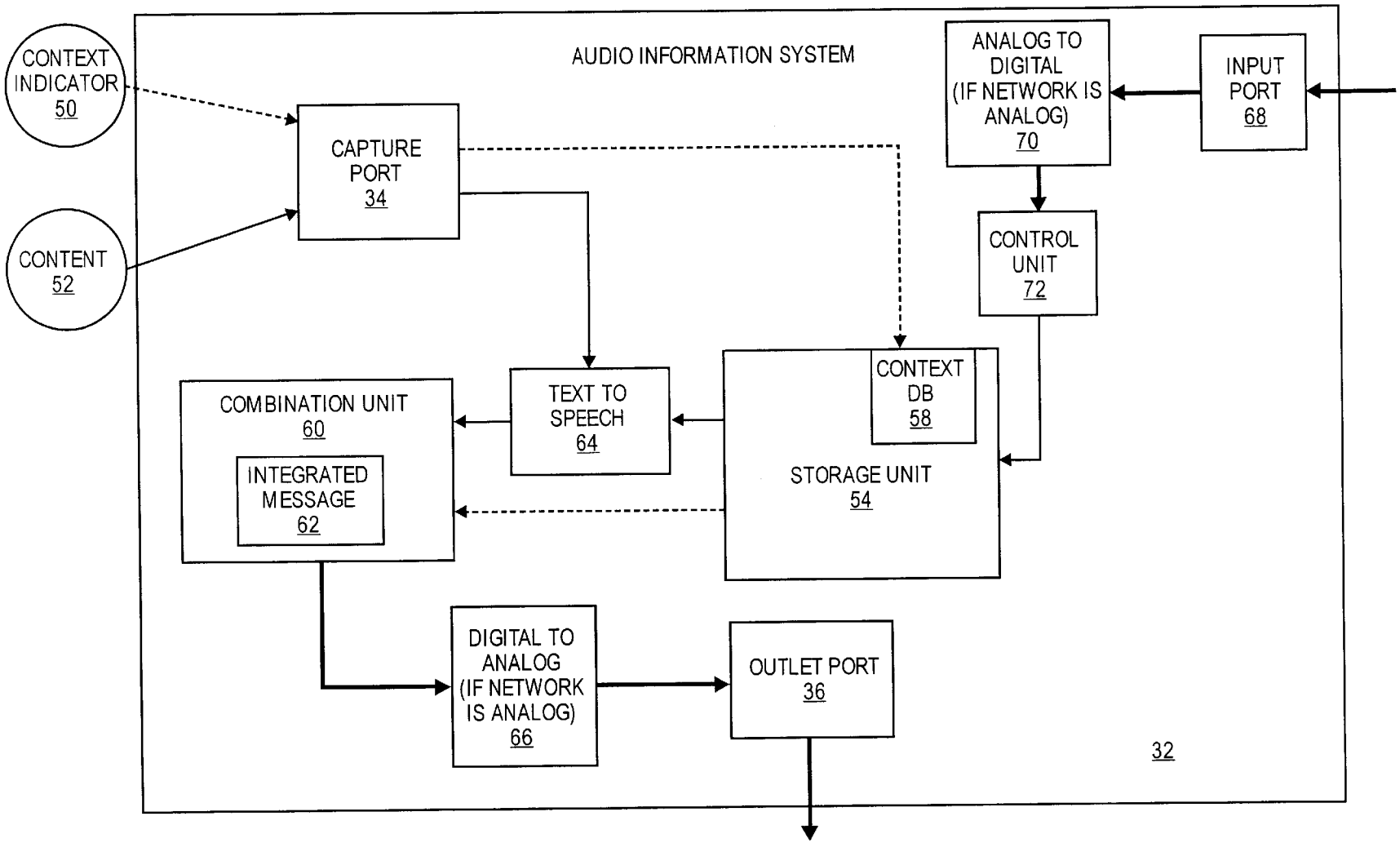
Figure 3C:
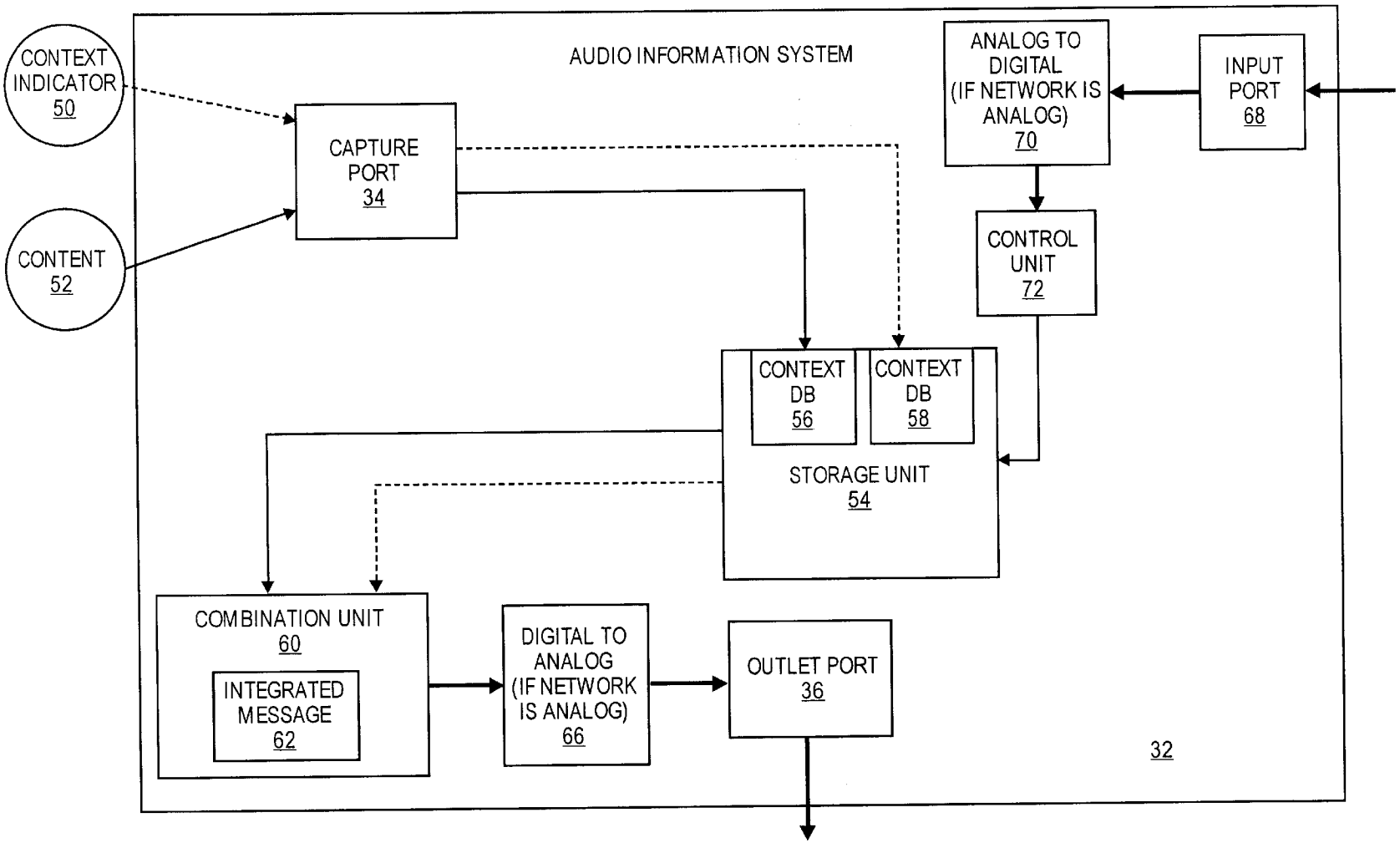

A storage unit 54 contains the information for the context indicator, usually in context database 58. In some embodiments, as shown in FIGS. 3A and 3C, the storage unit 54 also holds the content information in a content database 56. In addition, the storage unit 54 may include executable code that provides functionality for processing speech and non-speech information in accordance with the present invention.

At times, the audio information is stored in an audio file format, such as a wave file (which may be identified by a file name extension of ".wav") or an MPEG Audio file (which may be identified by a file name extension of ".mp3"). The wave and MP3 file formats are accepted interchange mediums for PC's and other computer platforms, such as Macintosh, allowing developers to freely move audio files between platforms for processing. In addition to the compressed or uncompressed audio data, these file formats may store information about the file, number of tracks (mono or stereo), sample rate, bit depth and/or other details. Note that any convenient compression or file format may be used in the audio system.

The storage 54 may contain volatile and/or non-volatile storage technologies. Example volatile storages include dynamic random access memory (DRAM), static RAM (SRAM) or any other kind of volatile storage. Non-volatile storage is typically a hard disk drive, but may alternatively be another magnetic disk, a magneto-optical disk or other read/write device. Several storages may also be provided, such as various types of alternative storages, which may be considered as part of the storage unit 54. For example, rather than storing the content and context information in individual files within one storage area, they may be stored in separate storages that are collectively described as the storage unit 54. Such alternative storages may include cache, flash memory, etc., and may also be a removable storage. As technology advances, the types and capacity of the storage unit may improve.

Further to the components of the audio information system 32, the input port 68 may be provided to receive information from the user. This information may be in analog or digital form, depending on the communication network that is in use. If the information is in analog form, it is converted to a digital form by an analog to digital 70 converter. This information is then fed to the control unit 72.

Where the system includes an input port 68, control unit 72 may be provided to process information from the user. User input may be in various formats such as audio, data signals, etc. This may involve performing speech recognition, security protocols and providing a user interface. The control unit may also decide which pieces of information are to be output to the user and directs the other components in the system to this end.

The system 32 further includes a combination unit 60. The combination unit 60 is responsible for merging the speech content and context indicator(s) to form the integrated message 62. The combination unit may unite the information in various ways with the resulting integrated message having some portion of speech and non-speech overlap.

In one embodiment, the combination unit 60 attaches the speech content to a complex form context indicator. A complex context indicator has speech and non-speech audio mixed together, such as the training context indicator described with reference to FIG. 1D. This complex context indicator may be formed by the combination unit overlapping segments or it may be pre-recorded and supplied to the combination unit where the context indicator already has a speech and non-speech overlap, the context indicator content stream may be connected end into end. Thus, the combination unit may attach the start of the speech content stream with end of the context indicator stream.

However, the combination unit may also intersect at least a portion of the speech content stream with at least a portion of the context indicator by combining the audio streams together, such as the message described in reference to FIG. 1C. In another example, the one or more content stream(s) may be combined with one or more context indicator(s) to create three or more overlapping channels in the integrated message.

In any case, the merging of the speech and non-speech files may involve mixing, scaling, interleaving or other such techniques known in the audio editing field. The combination unit may vary the pitch, loudness, equalization, differential filtering, degree of synchrony and the like, of any of the sounds.

The combination unit may be a telephony interface board, digital signal processor, specialized hardware, or any module with distinct software for merging two or more analog or digital audio signals, which in this invention may contain speech or non-speech sounds. The combination unit usually processes digital forms of the information, but analog forms may also be combined to form the message.

In another embodiment, rather than the combination unit 60 merging the speech and non-speech information, the combination unit 60 sends instructions to another component of the audio information system to combine the digital or analog signals to form the integrated message by using software or hardware. For example, the combination unit may send instructions to the system's one or more processors, such as a Motorola Power PC processor, an Intel Pentium (or x86) processor, a microprocessor, etc. The processor may run an operating system and applications software that controls the operation of other system components. Alternatively, the processor may me a simple fixed or limited function device. The processor may be configured to perform multitasking of several processes at the same time. In the alternative, the combination unit may direct the manipulation of audio to a digital processing system (DPS) or other component that relieves the processor of the chores involving sound.

Some embodiments of audio information system also have a text-to-speech (TTS) engine 64, to read back text information, e.g. email, facsimile. The text signals may be in American Standard Code for Information Interchange (ASCII) format or some other text format. Ideally, the engine converts the text with a minimum of translation errors. Where the text is converted to speech, the TTS engine may further deal with common abbreviations and read them out in "expanded" form, such as FYI read as "for your information." It may also be able to skip over system header information and quote marks.

Figure 3D:
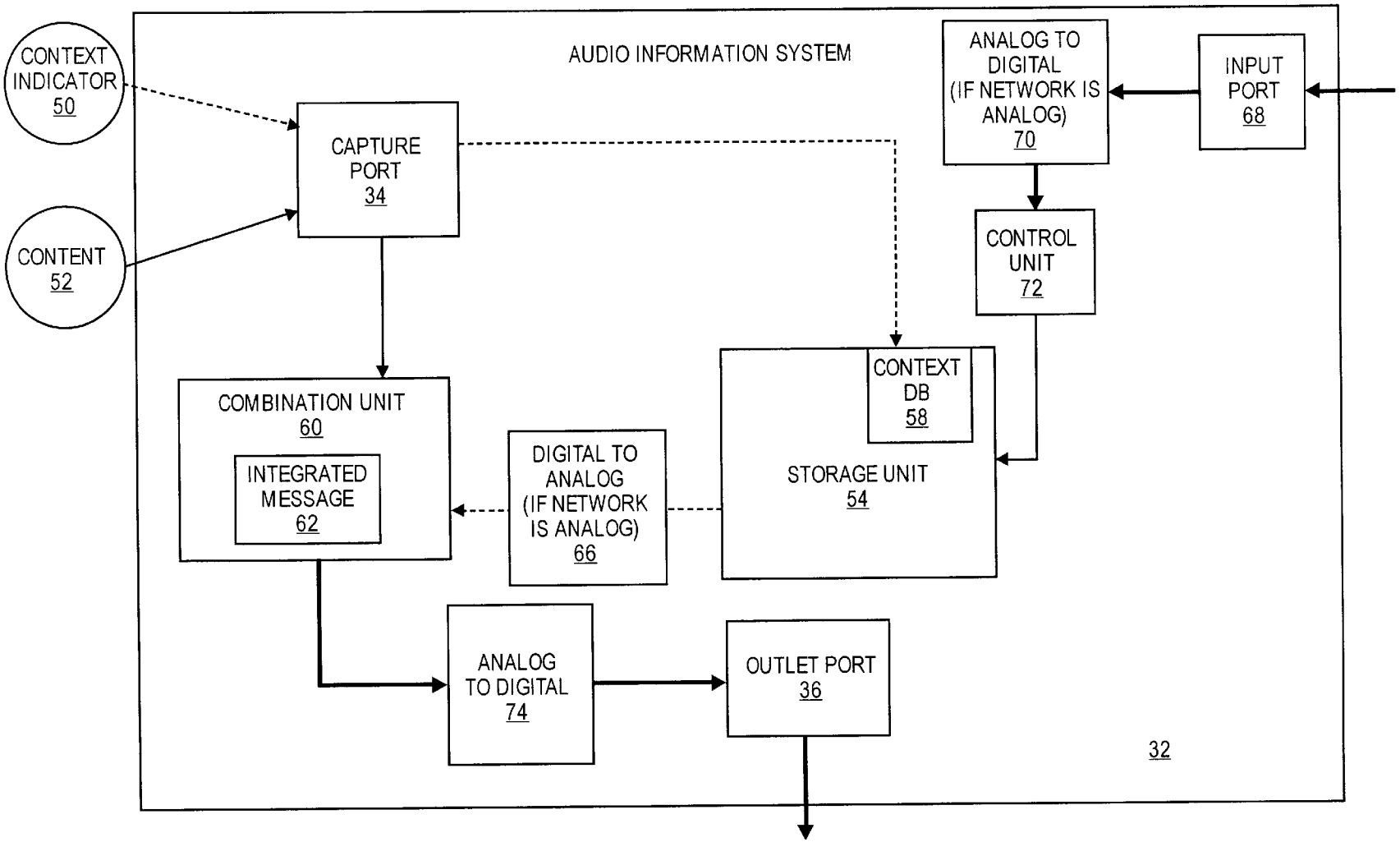

The conversion to sound, e.g. speech, by the TTS engine 64 typically occurs prior to the forming of the integrated message through the combination unit. As shown in FIG. 3A, the content information may be stored as text and the TTS engine 64 is coupled to the storage unit 54. In another configuration, as exemplified in FIG. 3B, the content enters the system as text and the TTS engine 64 is coupled to the capture port 34. Furthermore, the context information may also be text converted by the TTS engine 64. In still other systems, a TTS engine is not needed because the information is received and manipulated in audio form. For example, as shown in FIG. 3C, the content 52 and context 50 information is captured, stored and combined in audio form. FIG. 3D shows a system where content information is received in audio form and directly combined without being stored by the system. This direct-combination configuration is especially applicable where content information is in analog form, e.g. voice.

Usually, the information processed by the system is in a digital form and is converted to an analog form prior to the message being released from the system if the communication network is analog. A digital to analog converter 66 is used for this purpose. The converter may be an individual module or a part of another component of the system, such as a telephony interface board (card). The digital to analog converter may be coupled to various system components. In FIGS. 3A to 3B, the converter 66 is positioned after the combination unit 60. In FIG. 3D, the converter 66 is positioned prior to the combination unit. It is desirable for the content and context information to be in the same form in the combination unit.

In an alternative embodiment, the digital audio may not be converted to an analog signal locally, but rather shipped across a network in digital form and possibly converted to an analog signal outside of the system 32. Example embodiments may make use of digital telephone network interface hardware to communicate to a T1 or E1 digital telephone network connection or voice-over-IP technologies. FIG. 3D shows a system including an optional analog to digital converter 74, where digital messages are desired.

In alternative embodiments of an information-rich audio system, according to the present invention, sophisticated intelligence may be included. Such a system may decide to present certain content information by determining that the information is particularly relevant to a user, rather than simply conveying information that has been requested by a user. The system may gather ancillary information regarding the user, e.g. the user's identity, current location, present activity, calendar, etc., to assist the system in determining important content. For example, a system may have information that a user plans to take a particular airplane flight. The system may also receive information that the flight is cancelled and in response, choose to convey that information to the user as well as alternative flight schedules.

Figure 4:
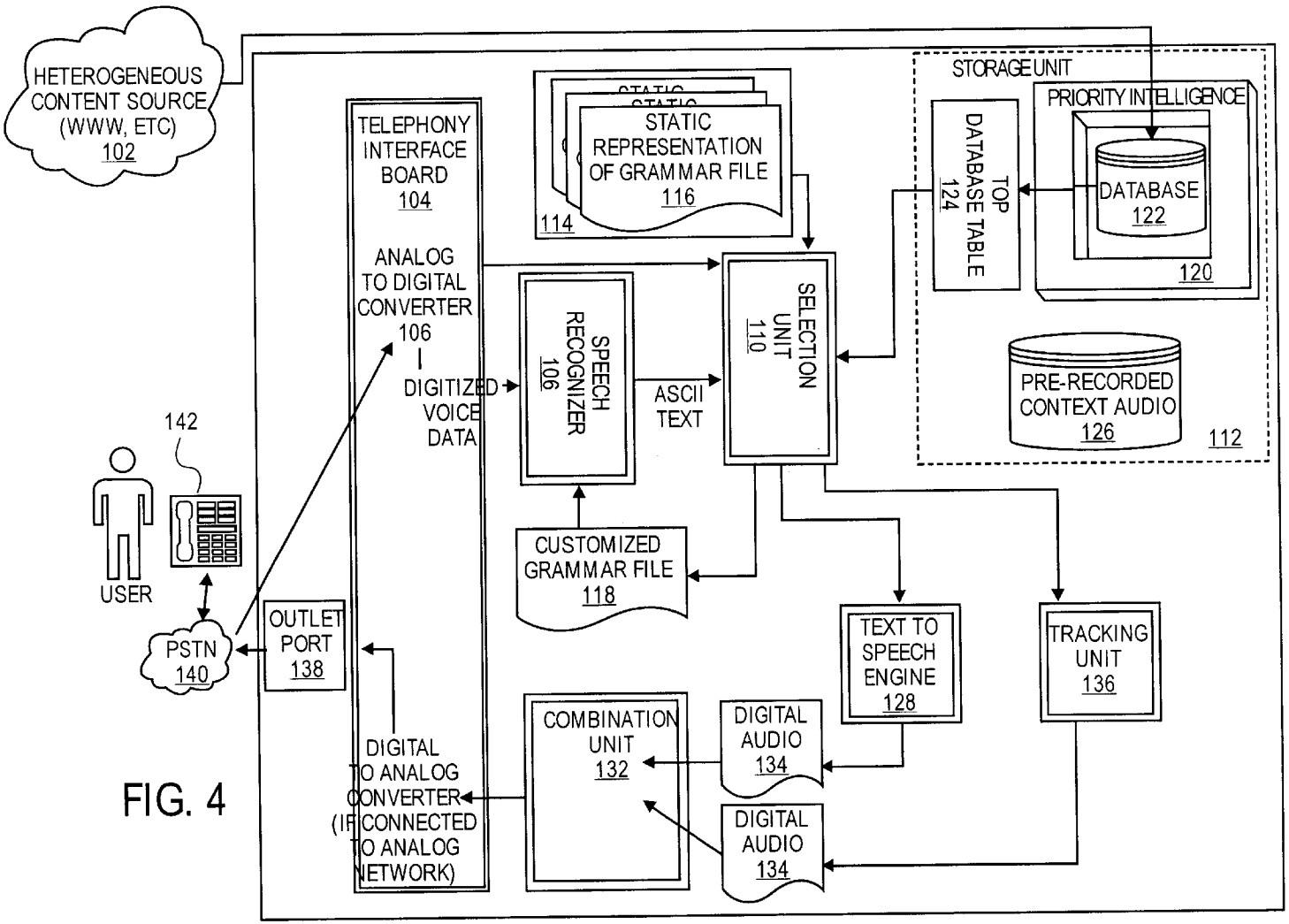
FIG. 4 is a block diagram of one embodiment of an audio information system having prerecorded context indicators, configured in accordance with the teachings presented herein.

One intelligent audio information system 100 is depicted in FIG. 4. The system may receive heterogeneous content information from a source 102, such as a network. In the particular example shown, the content information is in digital form from the World Wide Web, such as streaming media. This content information may also be in an analog form and be converted to digital. The content is delivered to a database 112 in storage unit 112.

Layers of priority intelligence 120 associated with the storage unit 112, may assign a priority ranking to the content information. The priority level is the importance, relevance, or urgency of the content information to the user based on user background information, e.g., the user's identity, current location, present activity, calendar, pre-designated levels of importance, nature of the content, subject matter that conflicts with or affects user specific information, etc. The system may receive or determine background information regarding the user. For example, the system software may be in communications with other application(s) containing the background information. In other embodiments, the system may communicate with sensors or receive the background information directly from the user. The system may extract the background information based on other information.

Based on ancillary information, e.g. user's current situation, the priority intelligence 120 dynamically organizes the order in which the information from the general content database 122 is presented to the user by placing it in priority order in the TOP database table 124.

A speech recognizer 108 processes the digital voice signals from the telephony interface board 104 and converts the data to text, e.g. ASCII. The speech recognizer 108 takes a digital sample of the input signals and compares the sample to a static grammar file and/or customized grammar 118 files to comprehend the users request. A language module 114 contains a plurality of grammar files 116 and supplies the appropriate files to the selection unit 110, based, inter alia, on anticipated potential grammatical responses to prompted options and statistically frequent content given the content source, the subject matter being discussed, etc. The speech recognizer compares groups of successive phonemes to an internal database of known words and responses in the grammar file. For example, based on the options and alternatives presented to the user by the computer generated voice prompt, the actual response was most similar to a particular anticipated response in the dynamically generated grammar file. Therefore the speech recognizer sends text corresponding to that response from the dynamically generated grammar file to the selection unit.

The speech recognizer 108 may contain adaptive filters that attempt to model the communication channel and nullify audio scene noise present in the digitized speech signal. Furthermore, the speech recognizer 108 may process different languages by accessing optional language modules.

The selection unit 110 may assign a sensitivity level to certain items that are confidential or personal in nature. If the information is to be communicated to the user through a device having little privacy, such as a speakerphone, then the selection unit adds a prompt to the user to indicate if the contents of the sensitive information may be delivered.

The selection unit 110 may also determine the form of a voice user interface to be presented to the user by analyzing each piece of data in the top database table 124. The selection unit may dynamically determine the speech recognition grammar used based on the ranking of the data, the user's location, the user's communication device, sensitivity level or the data, the user's present activity, etc. The selection unit may switch the system from a passive posture, which responds to user requests through a decision-tree that corresponds to user requests, to an active posture which notifies the user of information from the selected top database table item without having the user explicitly request the information.

The selection unit sends the content to a TTS engine 128 to convert the text to speech. The TTS engine sends the information to the combination unit as digital audio data 134. The selection unit 110 also sends characteristic information regarding the content to be sent to a tracking unit 136 to determine the appropriate context indicator for the message.

The tracking unit 136 determines if the user is trained in the use of any particular context indicator. This determination assumes the likelihood that the user is trained, based on information, such as the number of times the context indicator was outputted, the time period of output, user feedback, etc. There are many processes applicable for making this determination applied alone or in combination for each user.

In one method, repetitions are counted. The tracking unit 136 tallies the number of times that a context indicator signifying a particular characteristic has been output to a user as part of an integrated message over a given period of time. In accordance with the training, if the context indicator has been output to the user n times over the last m days, then the user is considered trained in it's use. In some instances, the system may conduct repeated training of the user. After the user is initially trained, the n times over the m days for output may be relaxed, i.e. decreased. Usually, reinforcement need not be as stringent as the initial training period.

The tracking unit has a database with a list of characteristics and a corresponding predetermined number of times (n) that it may take for a user to learn what any particular context indicator sound signifies. For each user, the tracking unit records how many times a particular context indicator has been output to the user during the last m days. The tracking unit 136 compares the number of times that the context indicator has been output over the days to the predetermined number of times. If the context indicator for a characteristic has been not been conveyed the predetermined number of times over a given time period, the user is considered untrained and the context indicator in the message includes a speech description of the characteristic. Otherwise, the user is considered trained on this particular characteristic and the speech description need not be included.

In another method of determining whether the user is trained, the user directs the system. For example, the user tells the system when he has learned the context indicator, i.e., whether training is required, or if he needs to be refreshed. In addition, there are other methods that may be employed to determine if training is required.

If the user is untrained in the use of the context indicator, then tracking unit selects from the context files 126 of pre-recorded context indicators, a context indicator that has both non-speech audio overlapped with a speech description of the characteristic. However, if the user is trained, the tracking unit retrieves from the pre-recorded files 126 a context indicator that has non-speech audio without a speech description.

The tracking unit sends the context indicator as digital audio data 135 to the combination unit 132. The content, having been converted to digital audio 136 by the TTS engine is sent to the combination unit 132. The integrated message is formed from these inputs by the combination unit 132 as described above.

The telephony interface board 104 converts the resulting integrated message from a digital form to an analog form of a constantly wavering electrical current. The system may optionally include an amplifier and speaker built into the outlet port 138. Alternatively the system communicates the integrated message to the user through a Public Switched Telephone Network (PSTN) 140 or another communication network to a telephone receiver 142. The audio message from the combination unit may be in analog or digital form. If in digital form, it may be converted to an analog signal locally or shipped across the network in digital form, where it may be converted to analog form external to the system. In this manner, the system may communicate the message to the user.

Figure 5:
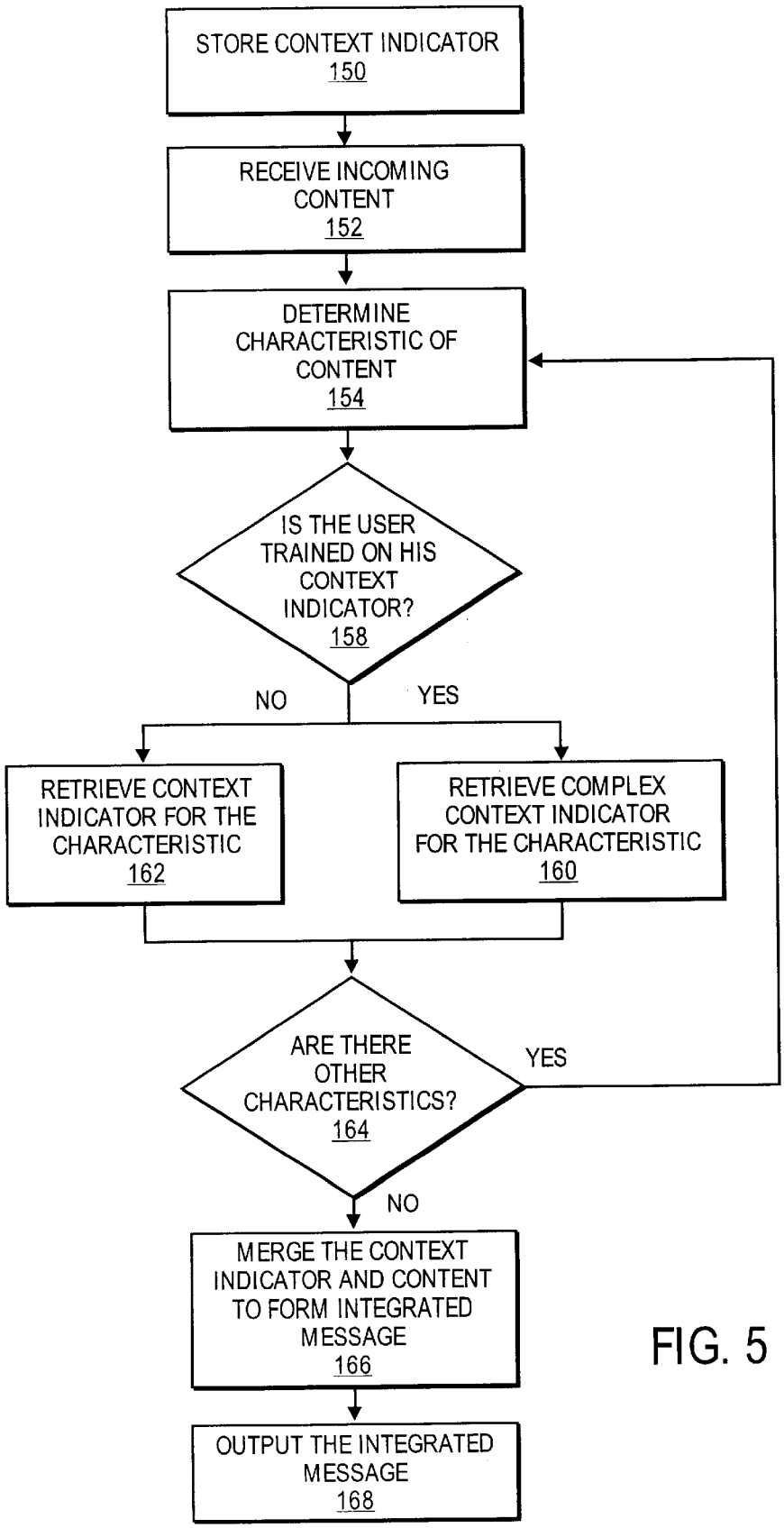
FIG. 5 illustrates a flow chart depicting one method for generating an audio message, according to the present invention.

One method of generating an audio message that may be employed by an audio information system as described above, is illustrated in the flow chart in FIG. 5. A context indicator is stored 150 and incoming content received 152. The content is examined and characteristic(s) determined 154. The system determines if the user is trained in the use of the context characteristic, 156. If the user is untrained, then a complex context indicator with overlapping speech (description) and non-speech, is used 160. Otherwise, a regular context indicator (non-speech) is retrieved. If there are further characteristics that are to be signified by a context indicator 164, the process is repeated for each additional content characteristic. When each context indicator has been retrieved, the content and context indicator(s) are merged 166 and the final integrated message output to a user 168.

Figure 6:
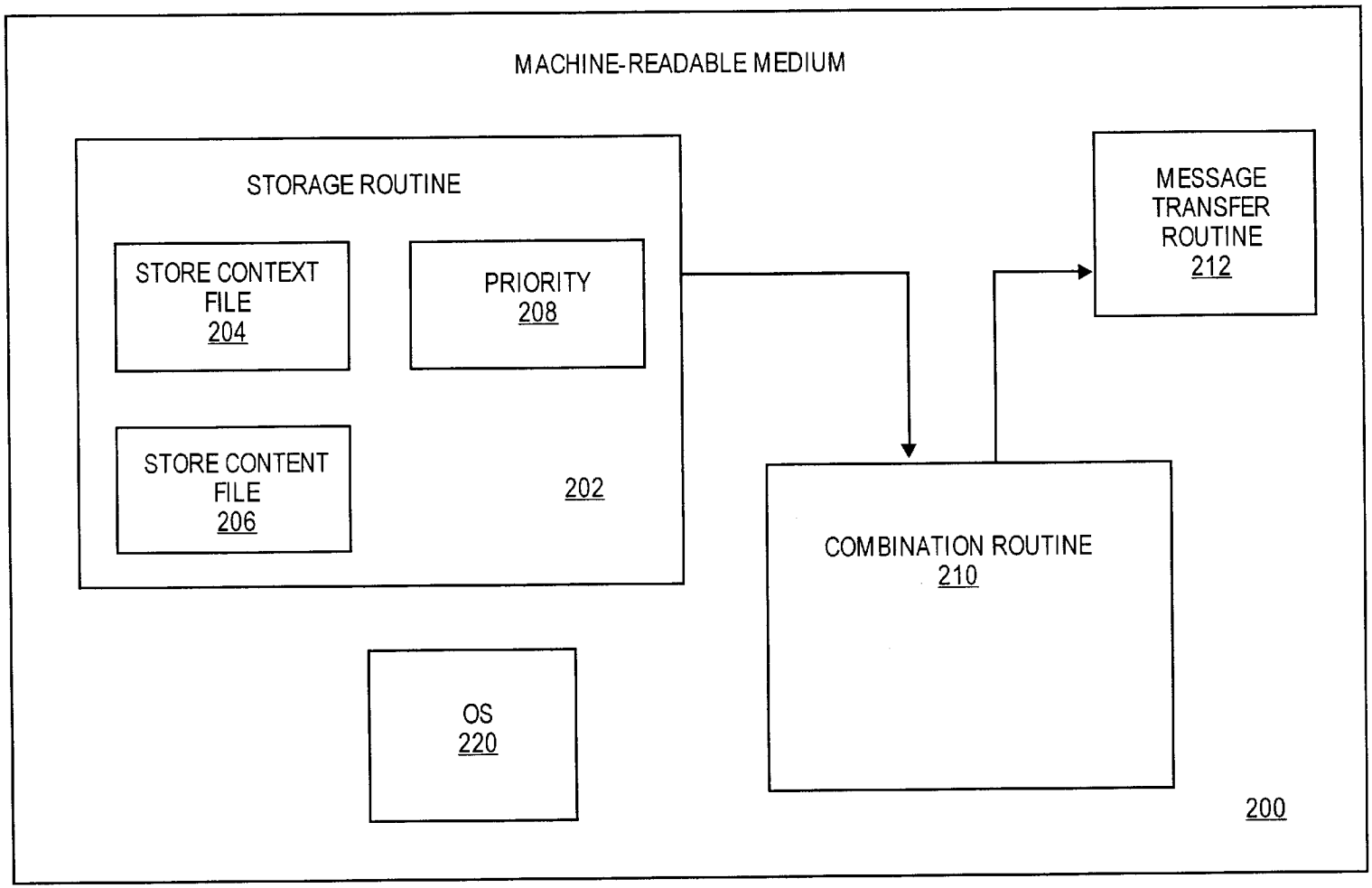
FIG. 6 is a block diagram of a machine-readable medium storing executable code and/or other data to provide one or a combination of mechanisms for processing audio information, in accordance with one embodiment of the present invention.

Various software components, e.g. applications programs, may be provided within or in communication with the system that cause the processor or other components to execute the numerous methods employed in creating the integrated message. FIG. 6 is a block diagram of a machine-readable medium storing executable code and/or other data to provide one or a combination of mechanisms for collecting and combining the stream of speech information with the context indicator, according to one embodiment of the invention. The machine-readable storage medium 200 represents one or a combination of various types of media/devices for storing machine-readable data, which may include machine-executable code or routines. As such, the machine-readable storage medium 200 could include, but is not limited to one or a combination of a magnetic storage space, magneto-optical storage, tape, optical storage, dynamic random access memory, static RAM, flash memory, etc. Various subroutines may also be provided. These subroutines may be parts of main routines or added as plug-ins or Active X controls.

The machine readable storage medium 200 is shown having a storage routine 202, which, when executed, stores context information through a context store subroutine 204 and content information through a content store subroutine 206, such as the storage unit 54 shown in FIGS. 3A–3C. A priority subroutine 208 ranks the information to be output to the user.

The medium 200 also has a combination routine 210 for merging content and context indicator. The message so produced may be fed to the message transfer routine 212. The generating of the integrated message by combination routine 210 is described above in regard to FIGS. 3A–3D. In addition, other software components may be included, such as an operating system 220.

The software components may be provided in as a series of computer readable instructions that may be embodied as data signals in a carrier wave. When the instructions are executed, they cause a processor to perform the message processing steps as described. For example, the instructions may cause a processor to communicate with a content source, store information, merge information and output an audio message. Such instructions may be presented to the processor by various mechanisms, such as a plug-in, ActiveX control, through use of an applications service provided or a network, etc.

The present invention has been described above in varied detail by reference to particular embodiments and figures. However, these specifics should not be construed as limitations on the scope of the invention, but merely as illustrations of some of the presently preferred embodiments. It is to be further understood that other modifications or substitutions may be made to the described information transfer system as well as methods of its use without departing from the broad scope of the invention. Therefore, the following claims and their legal equivalents should determine the scope of the invention.

What is claimed is:

1. An audio information system comprising:

a storage unit to store a context indicator having non-speech audio to signify a characteristic of a speech content stream;

a combination unit to merge the context indicator with the speech content stream to form an integrated message having the non-speech audio of the context indicator overlapped with speech audio;

an outlet port to output the integrated message; and a tracking unit to determine user training of the context indicator.

2. The audio information system of claim 1, wherein the merging is by overlapping the context indicator with at least a portion of the speech content stream.

3. The audio information system of claim 1, wherein the context indicator contains a speech audio overlapped with the non-speech audio.

4. The audio information system of claim 1, wherein the determination is by counting the number of times that the integrated message having the characteristic is outputted to a user over a given time period and comparing the outputted number to a predetermined number.

5. The audio information system of claim 1, wherein the context indicator includes a speech description of the characteristic if the user requires training.

6. The audio information system of claim 1, wherein the storage unit is to store more than one different type of speech content stream and the context indicator signifies the type of speech content stream to merge.

7. The audio information system of claim 1, wherein the storage unit is to store more than one speech content stream and the system further comprising a selection unit to select the speech content stream from the storage unit to merge with the context indicator.

8. The audio information system of claim 7, wherein the selecting of the speech information stream is based on a priority determination.

9. A method for generating an audio message, comprising:

storing a context indicator having non-speech audio to signify a characteristic of a speech content stream;

merging the context indicator with the speech content stream to form an integrated message having the non-speech audio of the context indicator overlapped with speech audio;

outputting the integrated message; and determining user training of the context indicator.

10. The method of claim 9, wherein the merging is by overlapping the context indicator with at least a portion of the speech content stream.

11. The method of claim 9, wherein the context indicator contains a speech audio overlapped with the non-speech audio.

12. The method of claim 9, wherein the determining is by counting the output number of times that the integrated message having the characteristic is outputted to a user over a given time period and comparing the outputted number to a predetermined number.

13. The method of claim 9, wherein the context indicator includes a speech description of the characteristic if the user requires training.

14. The method of claim 9, further including determining the characteristic of the speech content stream.

15. The method of claim 9, wherein more than one different type of speech content stream is stored and the context indicator signifies the type of speech content stream to merge.

16. The method of claim 9, wherein more than one speech content stream is stored and the method further includes selecting the speech content stream from the storage unit to merge with the context indicator.

17. The method of claim 16, wherein the selecting of the speech information stream is based on a priority determination.

18. A computer readable medium having stored therein a plurality of sequences of executable instructions, which, when executed by an audio information system for generating an audio message, cause the system to:

store a context indicator having non-speech audio to signify a characteristic of a speech content stream;

merge the context indicator with the speech content stream to form an integrated message having the non-speech audio of the context indicator overlapped with speech audio;

output the integrated message; and to determine user training on the context indicator.

19. The computer readable medium of claim 18, wherein the merging is by overlapping the context indicator with at least a portion of the speech content stream.

20. The computer readable medium of claim 18, wherein the context indicator contains a speech audio overlapped with the non-speech audio.

21. The computer readable medium of claim 18, wherein the determination is by counting the number of times that the integrated message having the characteristic is outputted to a user over a given time period and comparing the outputted number to a predetermined number.

22. The computer readable medium of claim 18, wherein the context indicator includes a speech description of the characteristic if the user requires training.

23. The computer readable medium of claim 18, further including additional sequences of executable instructions, which, when executed by the audio information system, cause the system to determine the characteristic of the speech content stream.

24. The computer readable medium of claim 18, wherein the characteristic is speech content type, speech content source, or relevance of the speech content stream.

25. The computer readable medium of claim 18, wherein more than one different type of speech content stream is stored and the context indicator signifies the type of speech content stream to merge.

26. The computer readable medium of claim 18, wherein more than one speech content stream is stored and further including selecting the speech content stream from the storage unit to merge with the context indicator.

27. The computer readable medium of claim 26, wherein the selecting of the speech information stream is based on a priority determination.

* * * * *